US006500040B2

(12) United States Patent
Browning et al.

(10) Patent No.: US 6,500,040 B2
(45) Date of Patent: Dec. 31, 2002

(54) METHOD FOR CLEANING PHOSPHOR SCREENS FOR USE WITH FIELD EMISSION DISPLAYS

(75) Inventors: Jim J. Browning, Boise, ID (US); Zhongyi Xia, Boise, ID (US); David A. Cathey, Boise, ID (US); Surjit S. Chadha, Meridian, ID (US)

(73) Assignee: Micron Technology, Inc., Boise, ID (US)

( * ) Notice: Subject to any disclaimer, the term of this patent is extended or adjusted under 35 U.S.C. 154(b) by 0 days.

(21) Appl. No.: 09/782,731

(22) Filed: Feb. 13, 2001

(65) Prior Publication Data

US 2001/0009060 A1 Jul. 26, 2001

Related U.S. Application Data

(63) Continuation of application No. 09/079,108, filed on May 14, 1998.

(51) Int. Cl.[7] ..... H01J 9/22

(52) U.S. Cl. ..... 445/24; 445/40; 445/59; 427/534; 15/1.51; 29/458

(58) Field of Search ..... 445/5, 24, 38, 445/40, 59, 25; 204/157.15, 164; 427/532, 540, 545, 551, 553, 554, 560, 534; 15/1.51

(56) References Cited

U.S. PATENT DOCUMENTS

| | | | | |
|---|---|---|---|---|
| 3,879,183 A | | 4/1975 | Carlson | |
| 4,978,885 A | | 4/1975 | White et al. | |
| 4,178,529 A | | 12/1979 | Kennedy | |
| 4,365,150 A | * | 12/1982 | Bateman | |
| 4,437,844 A | * | 3/1984 | Petito et al. | 445/5 |
| 4,475,057 A | | 10/1984 | Morris | |
| 4,503,388 A | | 3/1985 | Zehl et al. | |
| 4,818,914 A | | 4/1989 | Brodie | |
| 4,940,486 A | * | 7/1990 | Sommerville et al. | |
| 5,408,087 A | | 4/1995 | Thomas | |
| 5,639,356 A | | 6/1997 | Levine | |
| 5,744,907 A | | 4/1998 | Chadha et al. | |
| 5,861,713 A | | 1/1999 | Kondo et al. | |
| 6,037,710 A | | 3/2000 | Poole et al. | 445/25 |
| 6,049,168 A | | 4/2000 | Iosue et al. | 445/59 |
| 6,139,390 A | * | 10/2000 | Pothoven et al. | 445/24 |
| 6,254,449 B1 | * | 7/2001 | Nakanishi et al. | |

FOREIGN PATENT DOCUMENTS

| | | | |
|---|---|---|---|
| GB | 286632 | | 7/1928 |
| JP | 63-076333 | * | 4/1988 |

OTHER PUBLICATIONS

Aging of Electronic Phosphers in Cathode Ray Tubes, Pfahnl, pp. 204–208.

* cited by examiner

*Primary Examiner*—David P. Bryant
*Assistant Examiner*—Eric Compton
(74) *Attorney, Agent, or Firm*—TraskBritt

(57) ABSTRACT

A method for cleansing the phosphor screen of a display device comprising the removal of oxygen or sulfur from the surface of the phosphor, and/or its associated binder material, to a depth that prevents oxygen diffusion from the phosphor and/or binder, thereby creating an oxygen deficient surface on the phosphors.

20 Claims, 4 Drawing Sheets

METHOD FOR CLEANING PHOSPHOR SCREENS FOR USE WITH FIELD EMISSION DISPLAYS

CROSS-REFERENCE TO RELATED APPLICATION

This application is a continuation of application Ser. No. 09/079,108, filed May 14, 1998, pending.

BACKGROUND OF THE INVENTION

1. Field of the Invention

This invention relates to field emission displays, and more particularly to the removal of contaminants from the phosphor screens of such displays.

2. State of the Art

Cathode ray tube (CRT) displays, such as those commonly used in desktop computer screens, function as a result of a scanning electron beam from an electron gun impinging on phosphors on a relatively distant screen. The electrons increase the energy level of the phosphors. When the phosphors return to their normal energy level, they release the energy from the electrons as photons of light. The photons are transmitted through the glass screen of the display to the viewer.

Phosphors are known to decline in efficiency with use. There is an initial dramatic decrease in efficiency, followed by a slower, more gradual degradation over time. After the initial decrease in phosphor efficiency, the phosphors luminesce in a more uniform manner.

Phosphor coated screens are typically treated to bring about this initial aging, also known as "browning," prior to the sale of the display. Electron beam "scrubbing" is one approach currently used in the manufacture of cathode ray tubes (CRT) to burn-in or age the phosphors. This process has been accomplished with the use of the electron (cathode ray) gun after the display has been assembled. Hence, the process is performed at duty cycles similar to those used for viewing purposes, as illustrated in FIG. 1. In other words, the normal operation of the CRT serves to cleanse the screen.

Flat panel displays have become increasingly important in appliances requiring lightweight portable screens. Currently, such screens use electroluminescent or liquid crystal technology. A promising new technology is the use of a matrix-addressable array of field emission microtips to excite phosphors on a screen.

Similar to cathode ray tubes (CRT), field emission displays (FED) are comprised of an anode and a cathode. The anode comprises a phosphor coated glass plate. The phosphor luminesces when it is bombarded by electrons. However, unlike a CRT, the field emission device has a cold cathode which is comprised of arrays of micro-miniature field emitters.

The "scrubbing" or cleansing of the phosphor screen to remove contaminants would also be fabrication of field emission displays. However, most of the known "scrubbing" methods are inappropriate for such displays.

One reason current "scrubbing" techniques are unworkable in a field emission display (FED) is that the micro-miniature cathode emitter tips are much more sensitive to contamination than the large cathode ray gun of CRT. If the contaminants dissociated during the scrubbing process react with the cathode emitter tips, the emission, and resulting display performance, will be degraded. Hence, the standard CRT method of electron beam scrubbing is not a practical approach for use in field emission displays.

The inventors of the present invention have determined that the degradation in performance of the field emitters is a result of the oxygen dissociated from the phosphors of the display screen. If the emitter tips are fabricated from a silicon-based material, the presence of oxygen may result in the formation of silicon dioxide. An oxidation layer functions as an insulator, thereby inhibiting electron emission. Hence, in a field emission display, the cleansing process must remove oxygen and as well as other contaminants from the display screen.

Another difference between CRTs and FEDs is that field emission displays employ low voltage phosphors compared to those used in CRT displays. Low voltage phosphors characteristically luminesce at voltages less than 5000 V. The difference in the type and quality of the phosphors used in field emitter displays also necessitates the development of a new cleansing process for the screens used therein.

Despite the apparent benefits that could be achieved from "scrubbing" the phosphor screens, in the present manufacture of field emitter displays, the screens are not scrubbed appropriately, if they are scrubbed at all. Consequently, it is necessary to accept a certain amount of degradation in the emitter performance. Therefore, there is a need in the industry for a screen cleansing method that will be effective when used for field emission displays.

BRIEF SUMMARY OF THE INVENTION

One advantage of the present invention is that after the screen is properly scrubbed and the display is assembled, the display emitters will not experience a degraded performance as a result of contamination. This is a significant improvement, as degradation limits the lifetime and quality of the display.

In an example process in accordance with the present invention, the phosphor screen of the field emission display is bombarded by electrons at very high current densities (for example 1.0 mA/cm$^2$) and at low energies (for example those less than 1000 V) in order to remove oxygen contamination from the phosphors and/or phosphor binder material, prior to sealing the screen on the display. The removal of the oxygen prevents the degradation of the field emitters in the display during operation.

BRIEF DESCRIPTION OF THE SEVERAL VIEWS OF THE DRAWINGS

The present invention will be better understood from reading the following description of nonlimitative embodiments, with reference to the attached drawings, wherein below.

DETAILED DESCRIPTION OF THE INVENTION

Figure 1:
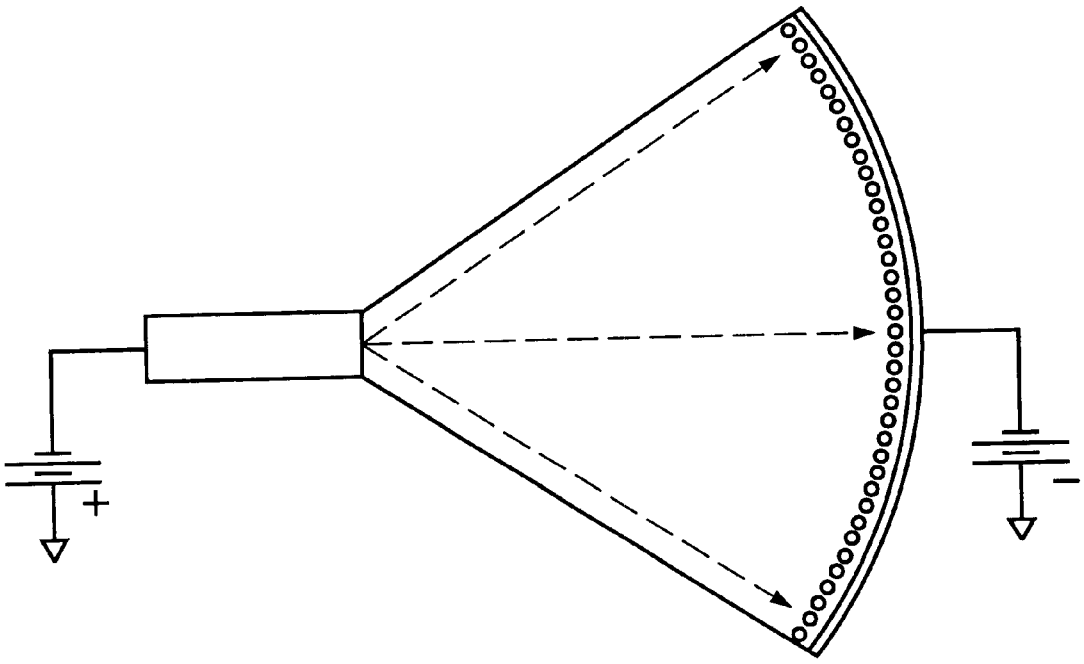
Fig. 1 (PRIOR ART)
FIG. 1 is a schematic cross-section of a representative cathode ray tube (CRT), comprising an electron gun and anode screen.
Figure 2:
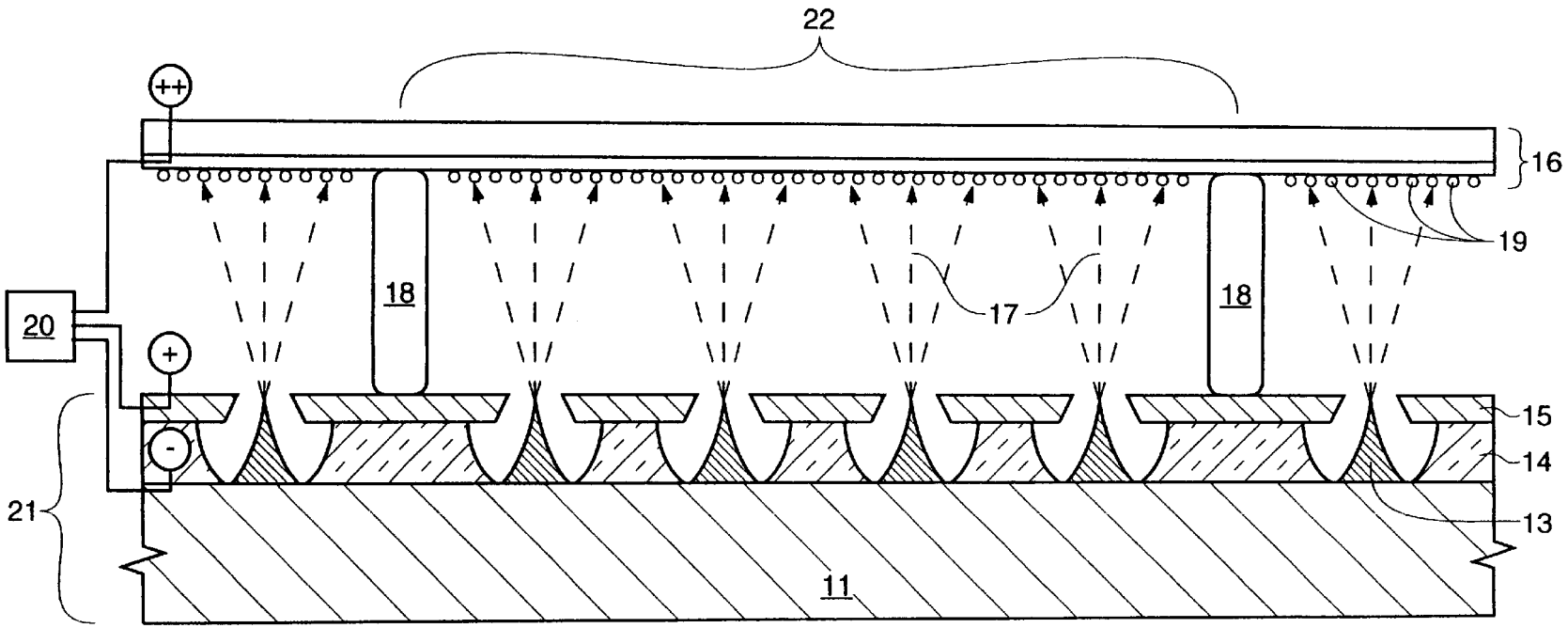
FIG. 2 is a schematic cross-section of a representative pixel of a field emission display comprising a faceplate with a phosphor screen, vacuum sealed to a baseplate which is supported by spacer structures.
Figure 3:
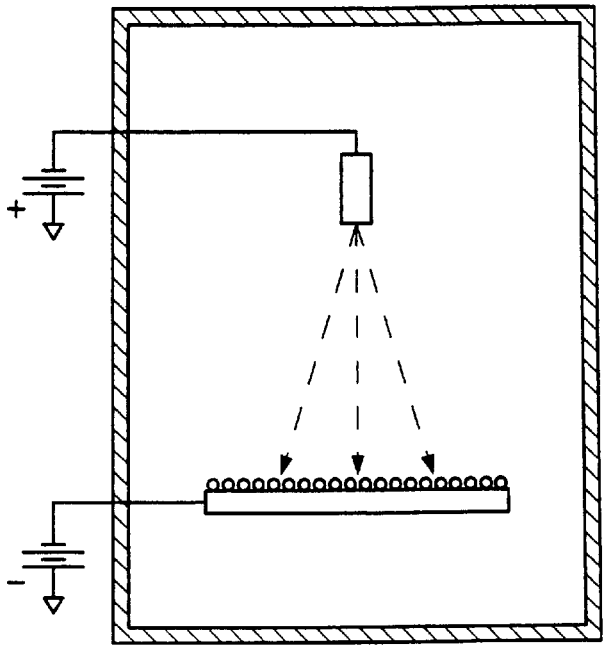
FIG. 3 is a schematic cross-section of the screen of the field emission display shown in FIG. 2, undergoing the process of the present invention.
Figure 4:
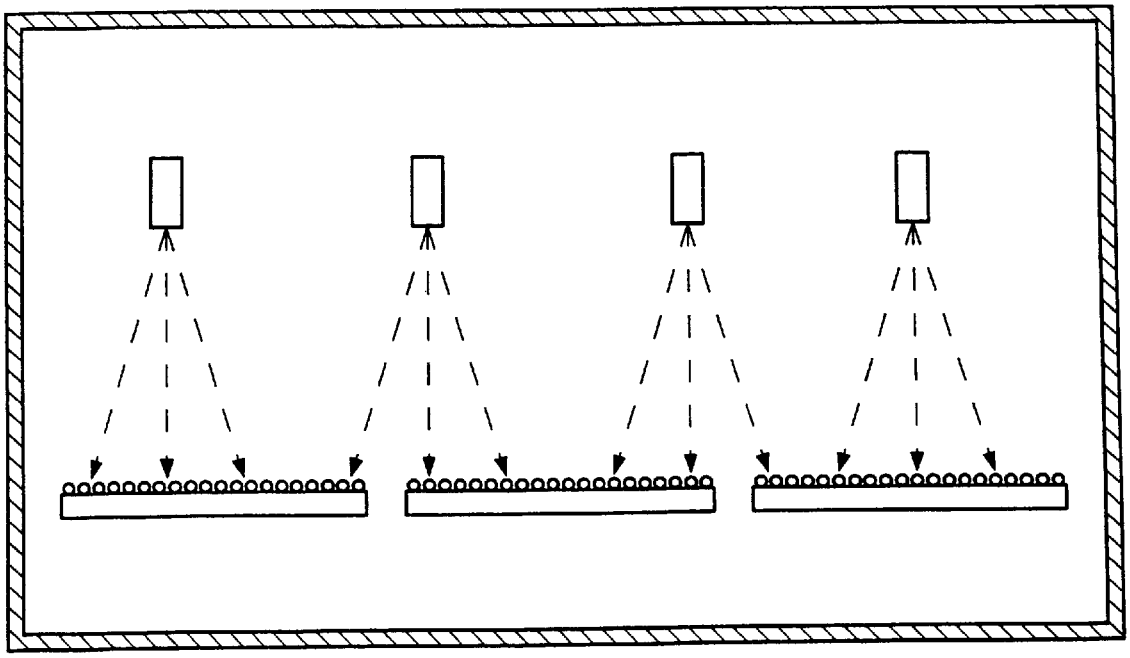
FIG. 4 is a schematic cross-section of the screen of the field emission display shown in FIG. 3, undergoing an alternative embodiment of the process of the present invention.

Referring to FIG. 2, a representative field emission display employing a display segment 22 is depicted. Each display segment 22 is capable of displaying a pixel of information, or a portion of a pixel, as for example, one green dot of a red/green/blue full-color triad pixel.

The most common type of FED is a gated field emitter with a cone shaped tip emission site 13 and a surrounding conductive gate 15. The emission site 13 is a protuberance which may have a variety of shapes and geometrys which have a fine micro-point at its end. Examples of other types of cold cathode emitters may include, but are not limited to, diamond patches, wedge shapes, or even surface emission structures. The process of the present invention is applicable to the above-mentioned emission types, as well as other displays containing field emitters.

Cathode emission sites 13 can be formed from the substrate 11 or from one or more deposited conductive films. For example, amorphous silicon or other conductive silicon can serve as an emission site on a glass substrate 11. Alternatively, other materials capable of conducting electrical current can be present on the surface of the substrate 11 for use as the emission site 13.

Surrounding the cathode emission sites 13 is gate 15 which serves as a grid structure for applying an electrical field potential relative to its respective cathode emission site 13. When a voltage differential, through source 20, is applied between the cathode emission sites 13 and the gate 15, a stream of electrons 17 is emitted toward a phosphor coated screen 16.

A dielectric insulating layer 14 is deposited about the conductive cathode emission sites 13. The insulating layer 14 also has an opening at the field emission site location.

The baseplate 21 typically comprises a matrix addressable array of cold cathode emission sites 13, the substrate 11 on which the emission sites 13 are created, the insulating layer 14, and the anode grid 15.

Disposed between the screen 16 and the baseplate 21 are located spacer support structures 18. Spacer support structures 18 function to support the atmospheric pressure which exists on the electrode screen 16 and baseplate 21 as a result of the vacuum which is created between the baseplate 21 and screen 16 for the proper functioning of the emitter sites 13.

Screen 16 is an anode. The screen 16 is most commonly fabricated from a glass material with phosphors 19 disposed thereon. The following is a representative list of phosphors which may be used in field emitter displays:

| | | | |
|---|---|---|---|
| $Y_2O_3$:Eu | ZnO:Zn | $Gd_2O_3$:Eu | $Y_3(Al,Ga)_5O_{12}$:Tb |
| $Y_2O_3$:Tb | $Zn_2SiO_4$:Mn | $Y_3Al_5O_{12}$:Tb | $Y(Al,Ga)_5O_{12}$:Ce |
| $Y_2O_3$Tm | $Zn_2SiO_4$:Ti | $Y_3Al_5O_{12}$:Ce | $Y_3(Al,Ga)_5O_{12}$:Tm |
| $Y_2O_3$:Er | $InBO_3$:Tb | $Y_3Al_5O_{12}$:Tm | $Y_2SiO_5$:Tb |
| $Y_2O_3$:Dy | $InBO_3$:$Eu_3$ | | $Y_2SiO_5$:Ce |
| | | | Y2(Ge,Si)$O_5$:Ce |

Alternatively, an indium tin oxide (ITO) coated glass surface can serve as the anode screen 16.

Because cathode emitter tips are very sensitive to contamination, it is preferable that highly pure phosphors be used. Such phosphors are prepared in an environment which minimizes sodium and other Group I and Group II elements from the phosphor lattice. See, for example: U.S. Pat. No. 5,601,751 entitled "Manufacturing Process for High-Purity Phosphors Having Utility in Field Emission Displays;" U.S. Pat. No. 5,662,831 entitled "Luminescent Phosphor and Methods Relating to Production Thereof;" U.S. Pat. No. 5,635,110 entitled, "Specialized Phosphors Prepared by a Multi-Stage Grinding and Firing Sequence;" U.S. Pat. No. 5,688,438 entitled "Preparation of High Purity Silicate-Containing Phosphors;" U.S. patent application Ser. No. 08/740,873 entitled, "Phosphor Manufacturing Process Employing Auto Feedback to Control Product Characteristics;" and U.S. patent application Ser. No. 08/587,722 entitled, "Binders for Field Emission Displays," all of which are commonly owned with the present application.

The binder is a material, such as potassium silicate or other silicate, which helps to hold phosphor particles on the glass or ITO coated glass surface. Other known binders include, but are not limited to: GR 650, Nyacol, Kasil, Nitrocellulose, Poly-Methyl-Methacrylate (PMMA), and Ethyl Cellulose.

Due to the nature of the field emission process, the cathode emission sites 13 are susceptible to contamination. In particular, an increase in the work function of the emitter will cause the performance of the emission sites 13 to degrade. This degradation takes the form of a decrease in the emission current of the tip of the emission sites 13. If the current is decreased too much, the display will no longer have an acceptable video image.

There are a number of manufacturing steps which can cause contamination of the microtips of the emission sites 13, thereby resulting in a degradation of the functionality of the emission sites 13. Since a degradation of the emission sites 13 is unacceptable, it is necessary to determine and subsequently remove the contaminating processes.

Without pre-treatment of the screen 16 according to the present invention, normal operation of the display causes contaminants to dissociate from the phosphors and from the corresponding binder used to hold the phosphors on the screen 16.

The contamination results as electrons from the cathode emitters 13 bombard the phosphor coated screen 16. The electrons 17 cause reactions with the phosphors or the phosphor binder which release contaminants. The present invention greatly reduces, and in some circumstances essentially eliminates, this major source of contamination which affects all FEDs.

Through a series of experiments, inventors of the present invention have determined that it is the release of oxygen (and/or sulfur) from the phosphor (and/or binder material that serve to coat the phosphor screen 16) which accounts for serious degradation problems in FEDs.

The electron 17 bombardment causes the oxygen bound up in the phosphor and/or in the binder to be released. This oxygen then transits through the anode-cathode vacuum gap and lands on the tips of emission sites 13. There, it reacts with the emission sites 13, and may oxidize the tip. Whether actual oxidation of the surface of the emission site 13 occurs has not been ascertained. However, the reaction does cause the degradation of the performance of the emission sites 13.

The process of the present invention involves a method for cleansing the phosphor screen of a display device to remove the oxygen (and/or sulfur) atoms/molecules from the surface of the phosphor, and/or its associated binder material, to a depth that minimizes oxygen (and/or sulfur) diffusion from the phosphor and/or binder, thereby creating an oxygen (and/or sulfur) deficient surface on the phosphor. Hence, subsequent electron bombardment of the phosphor does not result in further dissociation of oxygen (and/or sulfur) molecules.

Figure 5:
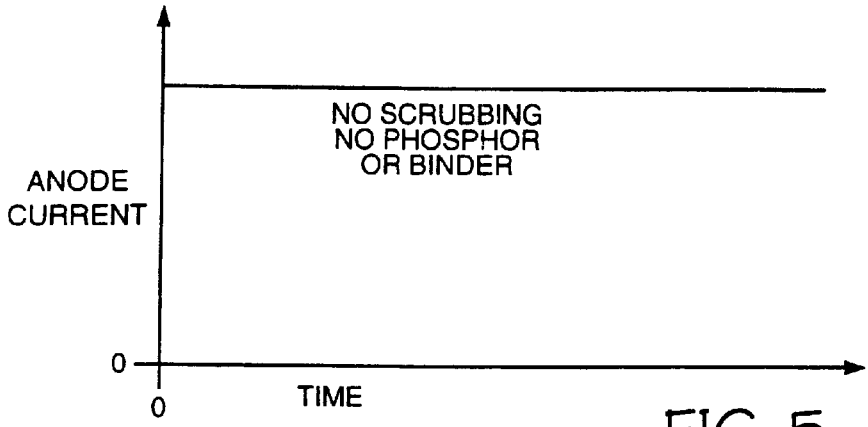
FIG. 5 is a graph illustrating the emission to the anode screen over time, when the screen has neither phosphor nor binder disposed thereon, and no scrubbing has been performed.

In order to establish the causes of the tip degradation process, emitter structures were run in display packages in which the anode had no phosphor or binder. The anode comprised ITO coated glass. The emitters did not degrade over thousands of hours. Their performance over time is indicated by the graph of FIG. 5. This experiment established a baseline for comparison for the source of the contamination.

Next, a silicate-based binder was placed on the ITO anode, and another package was tested. This time the emitters degraded. The same test was also performed with the phosphor on ITO.

Figure 6:
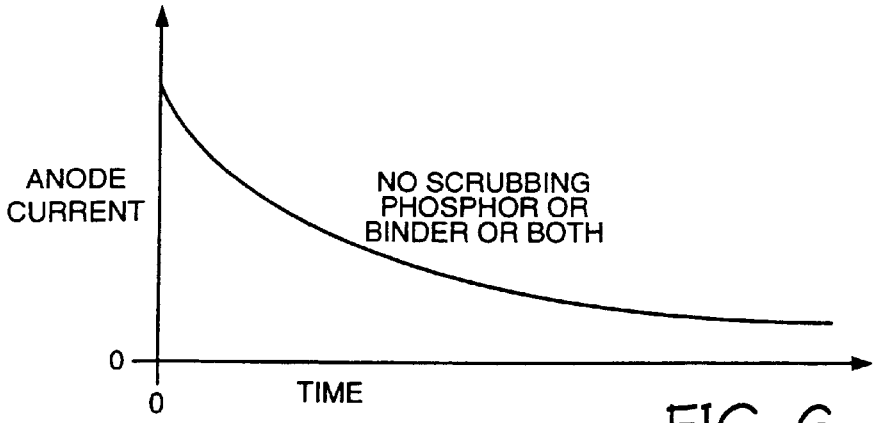
FIG. 6 is a graph illustrating the emission to the anode screen over time, when the screen has phosphors or binder or both disposed thereon, and no scrubbing has been performed.

Again, the emitters degraded. Hence, it was determined that source of the contamination was contained within the phosphor and binder. The graph of FIG. 6 illustrates the degradation in emitter performance over time of the screen coated with phosphor or binder.

Once the source of contamination was established as arising from the phosphor and binder, methods were sought to control the problem. High temperature baking (700° C.) and low current density electron beam scrubbing of the phosphor screen improved performance a little, but did not eliminate the problem.

Further, when the emitters degraded, it was also noticed that the phosphors themselves degraded. This degradation included a reduction in luminous efficiency, which is common in phosphors. It also included a "darkening" of the phosphors.

Subsequently, tests were performed in which phosphor screens were electron scrubbed at very high current densities (greater than 0.1 mA/cm$^2$, with typically 5 mA/cm$^2$). This scrubbing was done in a very clean, ultra high vacuum chamber. After running the scrub for a time, it was found that the phosphor darkened, and the efficiency decreased. If the screen was baked in atmosphere, at high temperatures (700° C.), the darkening was found to disappear. Then, if the screen was scrubbed again, the darkening reappeared.

Analysis indicated that this darkening was not carbon contamination, but rather reduction of oxygen bound at the surface of the phosphor. Likewise, it is believed that reduction of the silicate-based binder also occurred. If a darkened screen was then sealed in a package, there was no noticeable degradation of the emitters.

Figure 7:
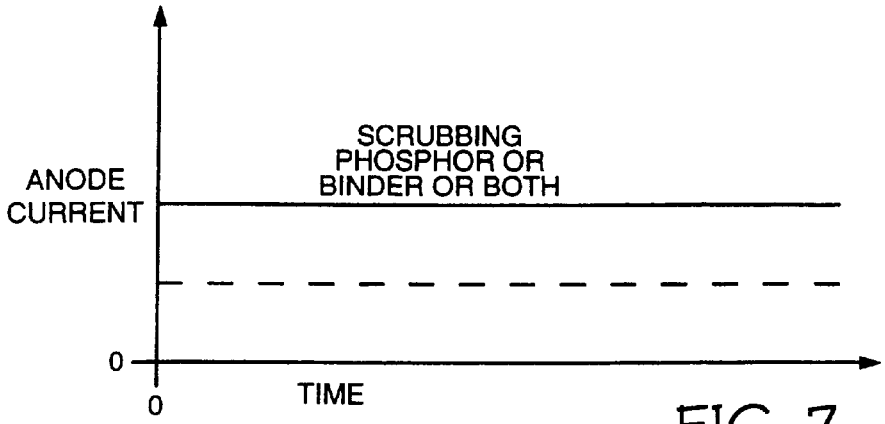
FIG. 7 is a graph illustrating the emission to the anode screen over time, when the screen has phosphors or binder or both disposed thereon, and scrubbing has been performed.

The performance over time of the emitters is illustrated in FIG. 7. The performance varies with the amount of scrubbing, as illustrated by the dotted line. The more the screen has been scrubbed, the more stable the performance.

The screen cleaning method of the present invention comprises electron bombardment of the phosphor screen with a high current density electron beam. If the current density is high enough (1–10 mA/cm$^2$), it will quickly (5–20 hours) reduce the phosphor and binder (i.e., remove the oxygen). The purpose of the high current density is to reduce the phosphor screen rapidly.

Therefore, unlike in a CRT display in which the electron beam often hits a section of the phosphor screen for a short time for each video frame, in the scrubbing process of the present invention, the beam bombards the screen at a much higher "duty cycle." The "duty cycle" is the percentage of time that electrons actually bombard the screen in a display. This "duty cycle" may be only 0.1% or less in the case of the CRT.

If the scrubbing of the screen was operated at this low "duty cycle," the cleaning process could take hundreds of hours. This makes it a commercially unrealistic process for use in a manufacturing environment. Hence, the scrubbing process must be performed at high "duty cycles" (greater than 1% and preferably, 10%–100%) for the process to be practical.

Typically, an electron dose of 10 to 100 C/cm$^2$ is needed to properly scrub the screen. For this to be done in a reasonable time (i.e., less than 10 hours), the current density and duty cycle must be high. For example, with a current density of 10 mA/cm$^2$ and a duty cycle of 50%, it would take approximately 3 hours for a 50 C dose. A lower scrub voltage may reduce the required dose.

There are significant differences between the process of the present invention and methods employed in CRTs. For example, in CRTs, cleaning is performed with an actual electron gun used in the display. Hence, the CRT display can be assembled prior to undergoing the scrubbing process. Additionally, the cleansing process used in CRTs is performed at "duty cycles" approximating the display operating "duty cycle."

In contrast, in the process of the present invention, the scrubbing is accomplished without employing the field emission cathode, prior to the assembly and sealing of the display. Hence, the electron gun used for the scrubbing process is not part of the completed display. If the actual display cathode were used, the display cathode would be degenerated and rendered useless. Further, the scrubbing process of the present invention is performed at much higher "duty cycles" than those at which the field emission display operates.

Because the primary source of the oxygen on the screen is at the surface of the phosphor, the screen can be scrubbed at very low electron beam energies (100 V–3000 V). This scrubbing reduces the surface of the phosphor without damaging the lattice deeper in the phosphor particle. Scrubbing according to the present invention reduces the phosphor, or binder, to a depth of approximately 50 to 75 angstroms (Å).

Since phosphors are subject to electron beam aging (Columbic aging), this low voltage scrubbing prevents premature degradation of the phosphor, although it does degrade to some degree. This lower degrade of the phosphor occurs because the scrubbing is done at a lower energy than the actual operation, e.g., scrubbing at 500 V relative to operating voltages 750 V.

This scrubbing can be accompanied by other processes which help improve the performance of the display. These include vacuum baking (400° C.–700° C. or higher, depending on the transparent substrate) prior to scrubbing to remove water. In addition, atmospheric baking (400° C.–700° C.) after a first scrub in order to remove other contaminants followed by another high current scrub will also improve the process.

An alternative to electron beam scrubbing is the use of a hydrogen plasma. The hydrogen ions could be used to reduce and thereby "clean" the phosphor.

Alternatively, chemical reduction reactions can be used, such as, but not limited to baking with carbon monoxide (CO).

However, the scrubbing provides a process which most clearly reproduces the degrade process in a display.

It should also be noted that the temperature of the phosphor screen (particularly at the surface of the phosphor), may be very high (greater than 500° C.) during the electron scrubbing. This high temperature may affect the cleaning of the screen. Higher temperatures may improve the cleaning, but if the temperature gets too high, thermal damage may occur. Therefore, temperature control during scrubbing may be used to improve the cleaning process.

Next the above process has been described with phosphors and binders. In some applications, a coating, such as, but not limited to, aluminum is placed over the phosphor to improve efficiency through reflection of the light. Scrubbing of aluminized or metallized screens will require higher anode voltages because the aluminum acts as a decelerating layer to the electron beam. Hence, "low voltage" may be 3000 V for an aluminized screen.

In addition, the aluminum itself has oxygen on its surface. Therefore, the aluminum surface may also need to be scrubbed. This may require a two-stage scrub. To this end, it may be desirable to sweep or change the electron beam energy during the cleaning process. For example, the energy could be swept from 200 V to 3000 V over a period of time (e.g., 15 minutes), and then, reduced back to 200 V.

This variation of beam energy will provide a more thorough cleaning of the oxygen by bombarding the screen over a range of energy. The energy of the beam can be changed at the electron source or by biasing the screen and changing the potential on it.

It should be noted that in addition to electron beam scrubbing, chemical reactions and plasmas, as well as other mechanisms, might be employed to remove oxygen from the surface of the phosphor, and from the binder. These might include the use of lasers, plasmas of gases other than hydrogen, ion beams, etc. The critical process for cleaning is to remove the oxygen from the surface in order to prevent degradation of the FED cathode emitters.

Finally, this cleaning process is described primarily for the cleaning of oxygen from phosphor screens. However, it is well known that sulfur can be released from sulfide-based phosphors. The sulfur rapidly degrades the emitters in an FED. The scrubbing process of the present invention may also be used to remove the sulfur from the surface of the phosphor, without greatly reducing the phosphor efficiency.

Hence, the scrubbing process can, in general, be used to remove or substantially eliminate materials other than oxygen. The present examples serve only to illustrate the extreme cases of oxygen and sulfur contaminants. However, the process of the present invention is not limited to the removal of these contaminants.

While the particular process as herein shown and disclosed in detail is fully capable of obtaining the objects and advantages herein before stated, it is to be understood that it is merely illustrative of the presently preferred embodiments of the invention and that no limitations are intended to the details of construction or design herein shown other than as described in the appended claims.

What is claimed is:

1. A method of manufacturing a field emission display comprising;

forming an anodic faceplate including depositing a layer of phosphor on a substrate;

forming a cathodic baseplate including a plurality of emitter tips;

removing oxygen contaminants from a surface of the phosphor layer to a depth of at least approximately 50 to 70 angstroms such that substantially no additional oxygen contaminants will dissociate from the layer of phosphor during subjection of the layer of phosphor to an electron energy at an intended operating level, wherein removing oxygen contaminants includes subjecting the phosphor layer to an electron energy at a voltage less than an intended operating voltage of the display; and sealingly assembling the faceplate and baseplate together subsequent the removal of the oxygen contaminants from the phosphor layer.

2. The method of claim 1, wherein removing oxygen contaminants further comprises subjecting the surface of the phosphor layer to an electron energy of greater than 1 $mA/cm^2$.

3. The method of claim 2, wherein the electron energy is approximately 100 to 3000 volts.

4. The method of claim 2, wherein the electron energy is less than approximately 1000 volts.

5. The method of claim 2, wherein the removing oxygen contaminants further comprises placing the phosphor layer in a vacuum prior to subjecting the phosphor layer to the electron energy.

6. The method of claim 2, further comprising maintaining the phosphor layer at approximately 500° C. during removal of the oxygen contaminants.

7. The method of claim 1, wherein the removing the oxygen contaminants comprises subjecting the phosphor layer to an electron energy having an electron dose of approximately 10 to 100 $C/cm^2$.

8. The method of claim 1, wherein the forming an anodic faceplate further comprises depositing a layer of aluminum over the phosphor.

9. The method of claim 8, further comprising removing oxygen contaminants from a surface of the aluminum layer prior to the sealingly assembling the faceplate and the baseplate together.

10. The method of claim 9, wherein the removing oxygen contaminants from phosphor layer includes penetrating the aluminum layer with an electron energy which is greater than approximately 3000 V.

11. The method of claim 9, wherein the removing oxygen contaminants from the phosphor layer and removing oxygen contaminants from the aluminum layer includes subjecting the aluminum and phosphor layers to an electron energy which is variable over time between approximately 200 V and 3000 V.

12. The method of claim 1, further comprising removing sulfur contaminants from a surface of the phosphor layer to a depth of approximately 50 to 75 angstroms.

13. The method of claim 12, wherein the removing the oxygen contaminants and the removing sulfur contaminants occurs substantially concurrently.

14. The method of claim 1, wherein the removing oxygen contaminants includes subjecting the entire surface of the phosphor layer to an electron energy at a duty cycle greater than 1%.

15. The method of claim 14 wherein the wherein the removing oxygen contaminants includes subjecting the surface of the phosphor layer to an electron energy at a duty cycle greater than approximately 50%.

16. The method of claim 1, wherein the removing oxygen contaminants comprises exposing the surface to a carbon monoxide gas.

17. The method of claim 1, wherein the removing oxygen contaminants comprises exposing the surface to a hydrogen plasma.

18. The method of claim 1, wherein the removing oxygen contaminants comprises exposing the phosphor layer to a laser.

19. The method of claim 1, wherein the removing oxygen contaminants comprises exposing the phosphor layer to an ion beam.

20. The method of claim 1, wherein depositing a phosphor layer includes depositing the phosphor layer with a binder.

* * * * *

UNITED STATES PATENT AND TRADEMARK OFFICE

CERTIFICATE OF CORRECTION

PATENT NO. : 6,500,040 B2 
DATED : December 31, 2002
INVENTOR(S) : Jim J. Browning et al.

It is certified that error appears in the above-identified patent and that said Letters Patent is hereby corrected as shown below:

Column 2,
Line 9, after “oxygen” delete “and”

Column 3,
Line 45, after “anode” change “grid” to -- gate --

Column 6,
Line 58, insert a comma after “to”

Column 7,
Line 3, insert a comma after “Next”
Line 53, change “comprising;” to -- comprising: --

Column 8,
Line 49, delete “wherein the” (first occurrence)

Signed and Sealed this

Twenty-second Day of July, 2003

JAMES E. ROGAN
*Director of the United States Patent and Trademark Office*